US005621781A

United States Patent [19]

Blake et al.

[11] Patent Number: 5,621,781

[45] Date of Patent: Apr. 15, 1997

[54] X-RAY TUBE

[75] Inventors: James A. Blake, Franklin; Steven D. Hansen, Port Washington; Jonathan R. Schmidt, Wales, all of Wis.

[73] Assignee: General Electric Company, Milwaukee, Wis.

[21] Appl. No.: 572,587

[22] Filed: Dec. 14, 1995

[51] Int. Cl.[6] ..... H01J 35/14

[52] U.S. Cl. ..... 378/138; 378/136

[58] Field of Search ..... 378/136, 137, 378/138, 121

[56] References Cited

U.S. PATENT DOCUMENTS 4,777,642 10/1988 Ono ..... 378/136

*Primary Examiner*—Don Wong

*Attorney, Agent, or Firm*—B. Joan Haushalter; John H. Pilarski

[57] ABSTRACT

A rotating X-ray tube comprises a cathode assembly including a cathode and a cathode current supply, and an anode assembly having an anode current controlled via the cathode current supply. A filament for emitting electrons is separated from the cathode. A cathode cup supports the filament and provides electron field shaping assistance. The X-ray tube further comprises a distributed capacitance for affecting the cathode cup electron field, and an insulator leakage resistance. The cathode cup is allowed to float on the insulator leakage resistance, whereby voltage associated with the distributed capacitance and the leakage resistance is allowed to remain relatively constant.

11 Claims, 3 Drawing Sheets

X-RAY TUBE

TECHNICAL FIELD

The present invention relates to X-ray tubes and, more particularly, to X-ray tubes which are turned on and off at a rapid rate.

BACKGROUND ART

The X-ray tube has become essential in medical diagnostic imaging, medical therapy, and various medical testing and material analysis industries. Typical X-ray tubes are built with a rotating anode structure for the purpose of distributing the heat generated at the focal spot. The anode is rotated by an induction motor consisting of a cylindrical rotor built into a cantilevered axle that supports the disc shaped anode target, and an iron stator structure with copper windings that surrounds the elongated neck of the X-ray tube that contains the rotor. The rotor of the rotating anode assembly being driven by the stator which surrounds the rotor of the anode assembly is at anodic potential while the stator is referenced electrically to ground. The X-ray tube cathode provides a focused electron beam which is accelerated across the anode-to-cathode vacuum gap and produces X-rays upon impact with the anode.

In an X-ray tube device with a rotatable anode, the target consists of a disk made of a refractory metal such as tungsten, and the X-rays are generated by making the electron beam collide with this target, while the target is being rotated at high speed. Rotation of the target is achieved by driving the rotor provided on a support shaft extending from the target.

Some X-ray tubes are turned on and off at a rapid rate as a part of their task, such as for diagnostic imaging, or any applications where it is desired to review a particular activity which is cyclic in nature. It is customary in such circumstances to provide a costly grid control power supply as a means of switching power ("mA", i.e., current) on and off, for bursts of X-ray. This power supply, or "grid tank", supplies a negative referenced switched voltage to the structure surrounding the filament known as the cathode cup. When the cathode cup or grid is substantially negative with respect to the thermionic emitter (i.e. filament), the surrounding electrode cloud is prevented from flowing to the anode and the tube is said to be "cut off" or "grided off" Our invention makes improved use of the cathode power supply and the normal distributed capacity, which is a part of the physical structures in an X-ray tube and the X-ray's tubes connecting wires, to provide a less costly, more reliable form of "mA" (current) switching. The grid power supply or "Grid Tank" is completely eliminated.

It would be desirable then to have improved use of the cathode power supply and the normal distributed capacity, to provide a less costly, more reliable form of "mA" switching.

SUMMARY OF THE INVENTION

The present invention provides improved use of the cathode power supply and the normal distributed capacity, which is a part of the physical structures in an X-ray tube and the connecting wires of the X-ray tube, to provide a less costly, more reliable form of power switching. The grid power supply, or grid tank, is completely eliminated.

In accordance with one aspect of the present invention, a rotating X-ray tube comprises a cathode assembly including a cathode and a cathode current supply, and an anode assembly having an anode current controlled via the cathode current supply. A filament for emitting electrons is separated from the cathode. A cathode cup supports the filament and provides electron field shaping assistance. The X-ray tube further comprises a distributed capacitance for affecting the cathode cup electron field, and an insulator leakage resistance. The cathode cup is allowed to float on the insulator leakage resistance, whereby voltage associated with the distributed capacitance and the leakage resistance is allowed to remain relatively constant.

Accordingly, it is an object of the present invention to provide improved use of the cathode power supply and the normal distributed capacity. It is a further object of the present invention to provide improved design and operation of X-ray tubes which are turned on and off at a rapid rate.

Other objects and advantages of the invention will be apparent from the following description, the accompanying drawings and the appended claims.

DETAILED DESCRIPTION OF THE PREFERRED EMBODIMENTS

The present invention relates to X-ray tubes which are required to be turned on and off at a rapid rate. Such X-ray tubes typically employ an anode assembly; a cathode assembly, including a cathode cup; a filament; and supporting structure, all housed within a vacuum enclosure. The cathode cup supports the filament and also helps with electron field shaping activity. The purpose of this invention is to improve use of the cathode power supply and the normal distributed capacity, to provide a more reliable form of switching.

Figure 1:
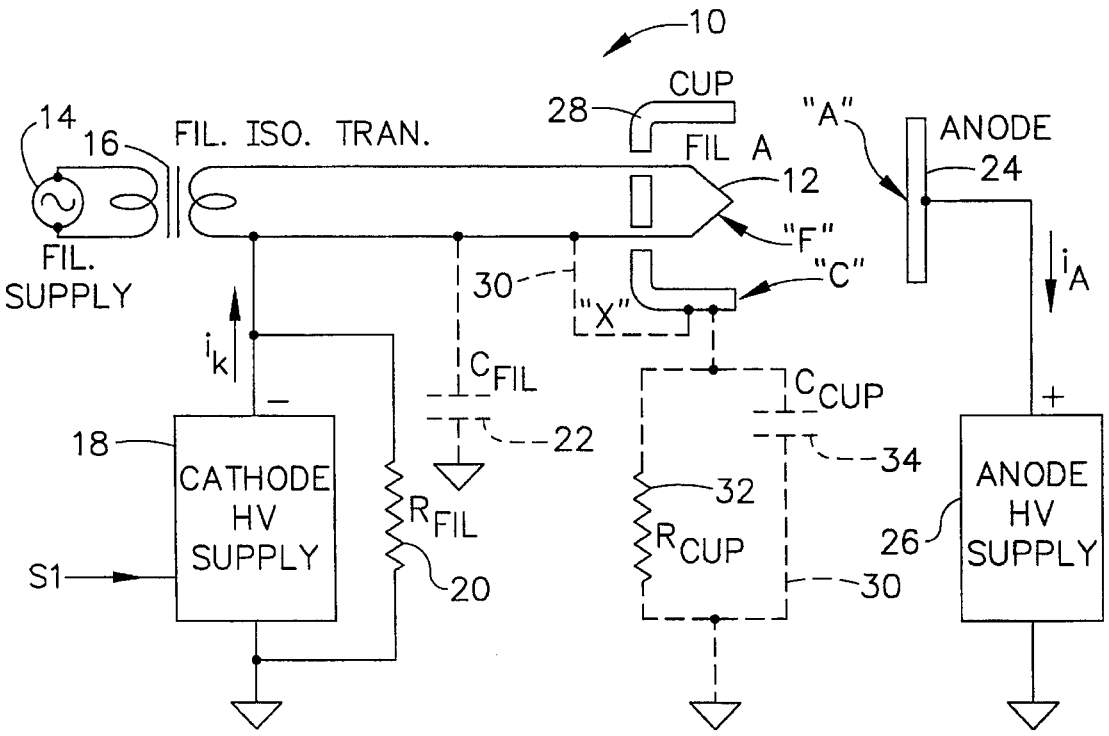
FIG. 1 is a schematic block diagram of the electronic function on which the present invention is based.

Referring now to the drawings, FIG. 1 illustrates a schematic block diagram of the electronic function of an X-ray tube, on which the present invention is based. The X-ray tube 10 is supplied with a large negative voltage, typically up to −150,000 volts with respect to the anode, for medical diagnostic purposes, on a filament 12. A conventional filament drive supply 14 is isolated from ground by a filament isolation transformer 16. Cathode supply 18 comprises a very large measuring resistance 20 which tends to discharge capacitor 22 towards ground.

Continuing with FIG. 1, the X-ray tube 10 also has a connection from anode 24 to an external sink of electrons, or anode supply 26. The anode supply 26 may produce from zero to 75,000 volts as a bias potential for the anode. The anode 24 is more positive than the cathode and attracts free electrons from the space charge which surrounds the filament 12 or other thermionic emitter in the cathode structure. The resulting anode current may be in the range of 10 mA to 500 mA.

The present invention comprises a "floating" cathode cup structure 28. The cathode cup is normally insulated from the filament 12 by the physical structure. Historically, the cathode cup has either been connected to the filament circuit using an additional connecting path, shown as dotted line 30 in FIG. 1, or connected to a grid supply tank. This connection has been eliminated by the present invention. The cathode cup is allowed to float on insulator leakage resistance from resistor 32 and distributed capacitance from capacitor 34. Furthermore, the X-ray tube according to the present invention is self-gridding, in that the grid power supply, or grid tank, is completely eliminated.

Figure 2:
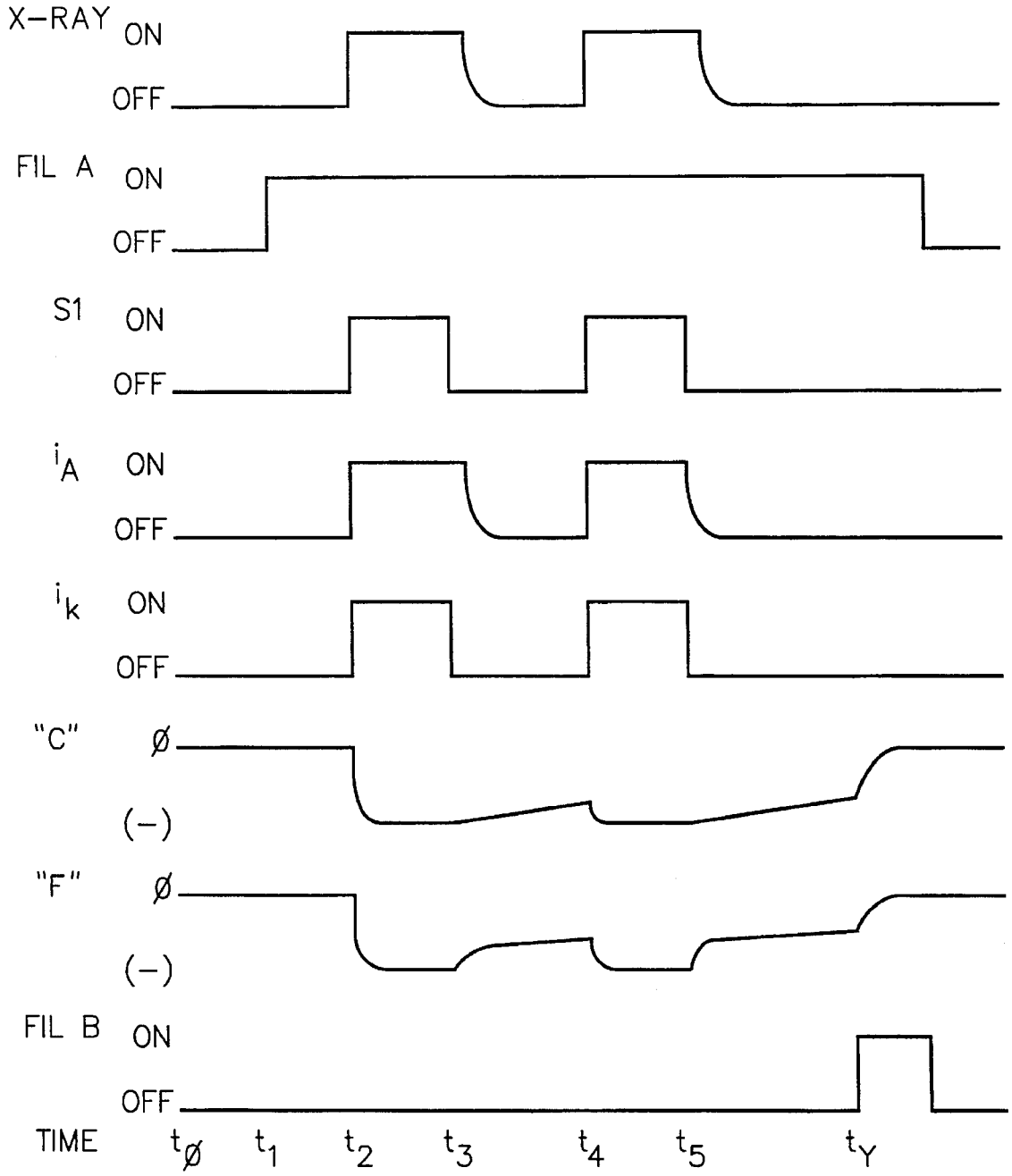
FIG. 2 is a graphical representation of the voltage and current relationships which occur in FIG. 1.

Referring now to FIG. 2, there is illustrated a graphical representation of the voltage and current relationships which occur in FIG. 1. At time $t_0$, all voltages and currents are at zero. No X-ray is produced and the system is ready to start its time sequence. Filament supply 14 is enabled at time $t_1$ and emission of filament 12 increases to its nominal level. Since no anode current ($i_A$) flows at time $t_1$, no X-rays are produced. At time $t_2$, cathode supply 18 ($S_1$) is enabled and current $i_K$ begins to flow. Also at time $t_2$, the anode goes to its operational level, which may be anywhere between zero in a grounded anode application to a high voltage such as 75 kV. Since all voltages are present at time $t_2$ and current $i_k$ is available, the cloud of electrons around filament 12 at point F in FIG. 1 will be attracted to points C and A. The flow of electrons into the distributed capacity of capacitors 22 and 34 quickly builds a negative voltage on point C which matches point F, and charge current flow into capacitor 34 ends. The electrons attracted from point F to anode point A are accelerated by the anode to cathode potential and strike the anode 24 at high velocity, which generates X-rays and produces current $i_A$.

At time $t_3$, control $S_1$ disables current $i_k$. Current $i_A$ continues to flow, discharging capacitor 22 and causing point F to become substantially less negative than it had been. The voltage which remains on point C with respect to point F is now quite negative. This relationship places a negative field around the cloud of electrons at F, stops the flow of electrons from cathode to anode, and causes the current $i_A$ to drop to zero. Since there are no electrons impacting anode 24 at point A, X-rays are no longer produced. The voltage difference on points F and C remains greater than the cathode-to-anode cut-off potential for an extended period, since capacitor 34 and insulation leakage resistor 32 have a discharge time constant which is very long and which always exceeds the time constant of capacitor 22 and resistor 20.

Continuing with FIG. 2, at time $t_4$, control $S_1$ enables current $i_k$. Capacitor 22 quickly charges to a voltage value approaching that on capacitor 34, and current $i_A$ again flows. X-rays are produced until control $S_1$ disables current $i_K$. This cycle can be repeated indefinitely. As can be seen in FIG. 2, the activity at time $t_5$ is a repeat of the activity at time $t_3$.

Figure 3:
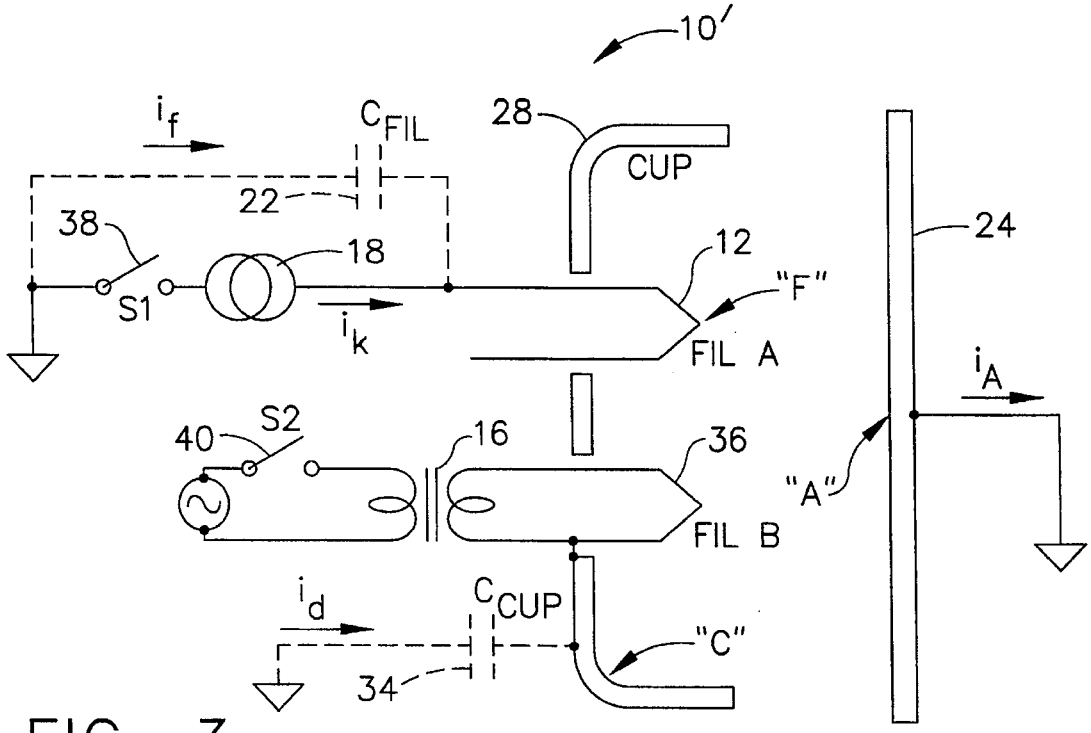
FIG. 3 is a schematic block diagram illustrating one embodiment for providing the required reset to zero voltage, in accordance with the present invention.

At time $t_r$ in FIG. 2, voltages at C, F and A, where A (not shown) represents the potential on the anode and remains constant, are all returned to zero. The schematic of FIG. 3 discloses one method for providing the required reset to zero voltage. In FIG. 3, filament 12 at point F corresponds to like points in FIG. 1. Filament 36 and its associated circuitry has been added to provide the reset function. Point A (anode) has been tied to zero for simplicity. This does not, of course, change the action of the circuit, since zero is within the acceptable anode voltage range.

At time $t_r$ in FIG. 2, cathode supply current $i_K$ has been disabled by switch 38 ($S_1$), and current $i_A$ has been reduced to zero by the negative bias on point C with respect to point F. The reset action for resetting voltage levels to zero begins with the closing of switch 40 ($S_2$) and the heating of filament 36. The heated filament 36 (thermionic emitter) generates its own cloud of electrons. These electrons are attracted to anode 24 and create a current $i_d$, which discharges capacitor 34. As the voltage on point C becomes less negative, the cloud of electrons surrounding filament 12 is no longer restricted, and current $i_f$ is created, which discharges capacitor 22 toward anode potential. Current $i_A$ is now the sum of current $i_f$ and $i_d$. When all capacitor charge has been neutralized, current flow stops and filament 36 can be turned off, via switch $S_2$, and reset is complete.

Figure 4:
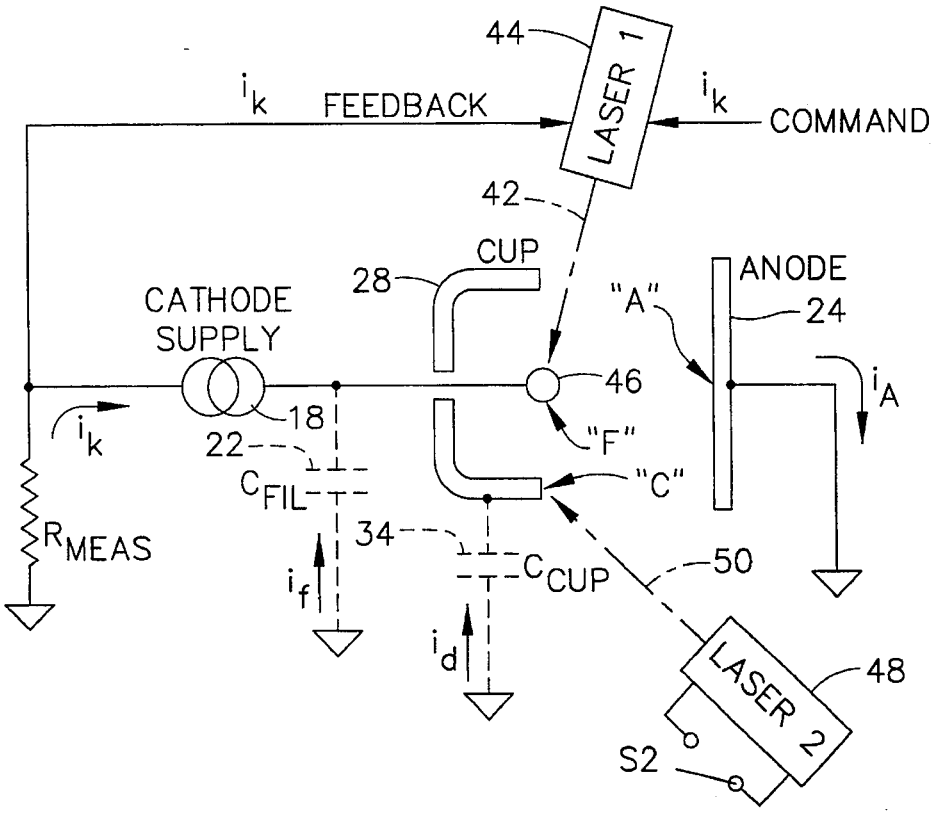
FIG. 4 is an alternative embodiment of the present invention, employing a laser beam.

Referring now to FIG. 4, there is illustrated an alternative embodiment of the present invention which uses a laser beam 42 from laser 44 to indirectly heat the electron emitter 46 to a controlled level using a measure of current $i_K$ as feedback to laser 44. The function of filament 12 in FIGS. 1 and 3 is duplicated by a first thermionic emitter 46 as heated by laser 44. Laser 48, with laser beam 50 directed to cathode cup structure 28, is added for reset purposes. The function of laser 48 is to produce a "hot spot", or second thermionic emitter, at point C on the surface of the cup 28, to accomplish the reset. It should be noted that the use of direct heating by filament or indirect heating can be mixed, such as by using one filament and one laser, or used interchangeably, to obtain the same operational result.

Figure 5:
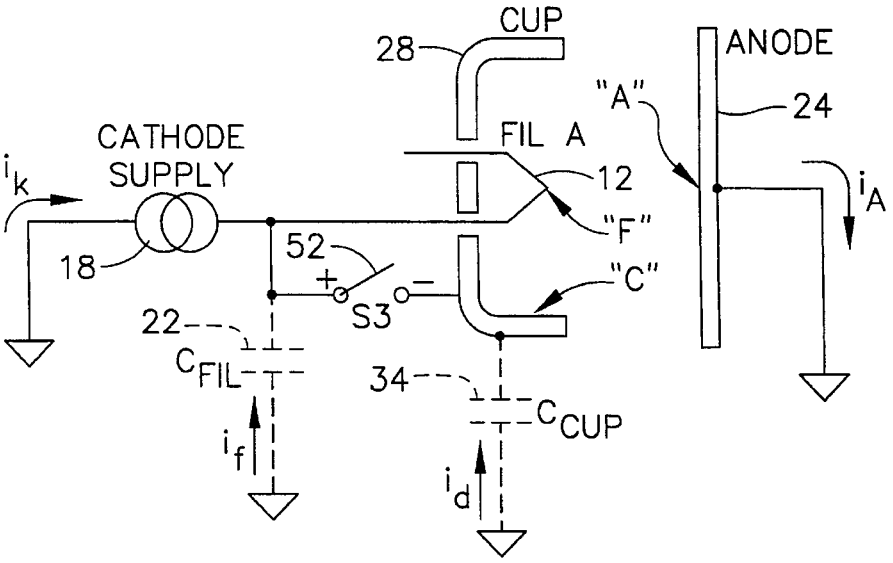
FIG. 5 is yet another alternative embodiment of the present invention, employing an electronic switch.

Referring now to FIG. 5, there is illustrated another alternative embodiment of the present invention. In FIG. 5, a switch 52 has been added, and switch 40 of FIG. 3 has been removed. Switch 52, which serves the same purpose as switch 40, is representative of an electronic switch. When switch 52 is momentarily closed, the negative charge on the cup with respect to the cathode, is neutralized, and current $i_A$ flows, resetting all points in the circuit to zero voltage. As will be obvious to those skilled in the art, this switch can be constructed of cascaded semiconductor devices, a mechanical relay or any other switching device which is capable of withstanding the cutoff voltage of the tube, and which can be isolated to withstand the full cathode voltage of an X-ray tube.

The invention has been described in detail with particular reference to certain preferred embodiments thereof, but it will be understood that modifications and variations can be effected within the spirit and scope of the invention.

We claim:

1. A rotating X-ray tube comprising:

a cathode assembly including a cathode and a cathode current supply;

an anode assembly having an anode current controlled via the cathode current supply;

an electron emitting means separated from the cathode for emitting electrons;

a cathode cup associated with the cathode assembly for supporting the electron emitting means and providing electron field shaping assistance;

a cathode cup distributed capacitance for affecting the cathode cup electron field; and a resistor for providing an insulator leakage resistance, whereby the cathode cup is allowed to float on the insulator leakage resistance.

2. A rotating X-ray tube as claimed in claim 1 wherein voltage associated with the distributed capacitance and the leakage resistance is allowed to remain relatively constant.

3. A rotating X-ray tube as claimed in claim 1 wherein the distributed capacitance has a first discharge time constant which is larger than a second discharge time constant associated with the electron emitting means.

4. A rotating X-ray tube as claimed in claim 1 further comprising a means for resetting voltage levels to zero voltage.

5. A rotating X-ray tube as claimed in claim 4 wherein the electron emitting means comprises a first filament.

6. A rotating X-ray tube as claimed in claim 5 wherein the means for resetting voltage levels to zero voltage comprises a second filament.

7. A rotating X-ray tube as claimed in claim 5 wherein the means for resetting voltage levels to zero voltage comprises a switch.

8. A rotating X-ray tube as claimed in claim 4 wherein the electron emitting means comprises a thermionic emitter.

9. A rotating X-ray tube as claimed in claim 8 wherein the thermionic emitter is heated by a laser.

10. A rotating X-ray tube as claimed in claim 8 wherein the means for resetting voltage levels to zero voltage comprises a laser.

11. A rotating X-ray tube as claimed in claim 1 further comprising self-gridding means for eliminating a need for a separate grid power supply or grid tank.

* * * * *